US009255553B2

(12) United States Patent
Dudar et al.

(10) Patent No.: US 9,255,553 B2
(45) Date of Patent: Feb. 9, 2016

(54) LEAK DETECTION FOR CANISTER PURGE VALVE

(71) Applicant: Ford Global Technologies, LLC, Dearborn, MI (US)

(72) Inventors: Aed M. Dudar, Canton, MI (US); Dennis Seung-Man Yang, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 115 days.

(21) Appl. No.: 13/939,096

(22) Filed: Jul. 10, 2013

(65) Prior Publication Data

US 2015/0019066 A1 Jan. 15, 2015

(51) Int. Cl.

| | |
|---|---|
| ***F02M 25/08*** | (2006.01) |
| ***F02D 41/00*** | (2006.01) |
| *F02D 29/02* | (2006.01) |
| *F02D 41/22* | (2006.01) |

(52) U.S. Cl.

CPC ..... *F02M 25/0809* (2013.01); *F02D 41/0035* (2013.01); *F02D 29/02* (2013.01); *F02D 2041/225* (2013.01); *F02D 2200/0606* (2013.01)

(58) Field of Classification Search

CPC ..... F02M 25/0809; F02M 25/0818; F02M 25/08; F02M 25/089; F02M 25/0827; F02M 35/10229; F02M 2025/0881; F02M 21/08; F02M 25/0836; F02M 25/0854; F02M 25/0872; F02D 2041/228; F02D 2200/0402; F02D 2200/0406; F02D 2200/0614; F02D 41/003; F02D 41/0042; F02D 41/021; F02D 41/1458; F02D 41/221; B60K 2015/03514; B60K 2015/0319; B60K 15/03519; B60K 2015/03302; B60K 2015/03523; B60K 6/48; B60K 15/035; B60K 2015/03561

USPC ..... 701/51, 102, 103, 113, 114, 34.4, 32.8; 123/519, 520, 521, 458, 499, 685

See application file for complete search history.

(56) References Cited

U.S. PATENT DOCUMENTS

| | | | | |
|---|---|---|---|---|
| 5,295,472 | A * | 3/1994 | Otsuka et al. | 123/520 |
| 5,408,866 | A * | 4/1995 | Kawamura et al. | 73/40 |
| 5,425,344 | A * | 6/1995 | Otsuka et al. | 123/520 |
| 5,623,914 | A * | 4/1997 | Kawamoto et al. | 123/689 |
| 5,873,352 | A * | 2/1999 | Kidokoro et al. | 123/520 |
| 6,196,203 | B1 * | 3/2001 | Grieve et al. | 123/520 |
| 6,321,727 | B1 * | 11/2001 | Reddy et al. | 123/520 |
| 6,446,614 | B1 * | 9/2002 | Matsuoka et al. | 123/516 |
| 6,769,290 | B2 * | 8/2004 | Fabre | 73/49.7 |
| 7,366,604 | B2 | 4/2008 | Ishii et al. | |
| RE41,660 | E * | 9/2010 | Morinaga et al. | 73/114.39 |
| 2002/0011094 | A1 * | 1/2002 | Cook et al. | 73/49.2 |

(Continued)

FOREIGN PATENT DOCUMENTS

| | | |
|---|---|---|
| JP | 2004251251 A | 9/2004 |
| JP | 2007187143 A | 7/2007 |
| JP | 2010019212 A | 1/2010 |

*Primary Examiner* — Truc M Do

(74) *Attorney, Agent, or Firm* — James Dottavio; Alleman Hall McCoy Russell & Tuttle LLP

(57) ABSTRACT

Methods and systems for detecting a leak in a canister purge valve are disclosed. In one example approach, a method comprises indicating a leak in response to a temperature change in a fuel vapor canister coupled to a fuel tank in an emission control system while the engine is in operation and a purge valve is closed.

17 Claims, 4 Drawing Sheets

(56) References Cited

U.S. PATENT DOCUMENTS

| | | | | |
|---|---|---|---|---|
| 2002/0148354 | A1* | 10/2002 | Amano et al. | 96/112 |
| 2002/0162457 | A1* | 11/2002 | Hyodo et al. | 96/109 |
| 2004/0154596 | A1* | 8/2004 | Mitani et al. | 123/509 |
| 2005/0022588 | A1* | 2/2005 | Hayakawa et al. | 73/118.1 |
| 2005/0262932 | A1* | 12/2005 | Hayashi et al. | 73/118.1 |
| 2007/0068227 | A1* | 3/2007 | Tsuyuki et al. | 73/49.7 |
| 2007/0084274 | A1* | 4/2007 | Takayanagi | 73/118.1 |
| 2007/0101973 | A1 | 5/2007 | Wolber et al. | |
| 2007/0246025 | A1* | 10/2007 | Sato et al. | 123/520 |
| 2009/0099795 | A1* | 4/2009 | Behar et al. | 702/51 |
| 2010/0132676 | A1* | 6/2010 | Kitamura et al. | 123/520 |
| 2010/0252006 | A1* | 10/2010 | Reddy | 123/519 |
| 2011/0079201 | A1* | 4/2011 | Peters et al. | 123/520 |
| 2011/0139130 | A1* | 6/2011 | Siddiqui | 123/520 |
| 2011/0166765 | A1* | 7/2011 | DeBastos et al. | 701/102 |
| 2011/0168140 | A1* | 7/2011 | DeBastos et al. | 123/521 |
| 2011/0186020 | A1* | 8/2011 | Makino | 123/521 |
| 2011/0265768 | A1* | 11/2011 | Kerns et al. | 123/521 |
| 2011/0295482 | A1* | 12/2011 | Pearce et al. | 701/102 |
| 2012/0152210 | A1* | 6/2012 | Reddy et al. | 123/520 |
| 2012/0186333 | A1* | 7/2012 | Nishimura et al. | 73/40.5 R |
| 2012/0211087 | A1* | 8/2012 | Dudar et al. | 137/12 |
| 2013/0297178 | A1* | 11/2013 | Hill et al. | 701/102 |
| 2013/0312494 | A1* | 11/2013 | Nishimura | 73/45.5 |

* cited by examiner

LEAK DETECTION FOR CANISTER PURGE VALVE

BACKGROUND/SUMMARY

To reduce discharge of fuel vapors into the atmosphere, motor vehicles induct fuel vapors from a fuel tank into the engine. An evaporative emission control system including a carbon canister is also coupled to the fuel tank to adsorb fuel vapors under some conditions when the internal combustion engine is not running. The carbon canister, however, has limited capacity, thus engine running manifold vacuum may be used to desorb the vapor from the carbon canister via opening of a purge valve. Desorbed vapors are combusted in engine.

Diagnostics may be performed on the evaporative emission control system, e.g., to detect leaks in the system. Leak diagnostics may be based on pressure or vacuum changes in one or more components of the emissions control system during certain conditions. The inventors herein have recognized that a common leak path in an emission control system is through a canister purge valve located in a conduit between a fuel vapor canister and the engine.

In some approaches, pressure readings from a pressure sensor in a fuel tank may be monitored during engine operation while the canister purge valve is commanded closed in order to determine if a leak is present in the canister purge valve. For example, if a leak is present in the purge valve while the purge valve is closed and the fuel tank is sealed off from the atmosphere, then a vacuum may build in the fuel tank during engine operation which is indicative of a leak in the purge valve. The inventors herein have recognized that such approaches rely on a pressure sensor in the fuel tank to diagnose leaks and if the pressure sensor degrades then leak testing may be compromised. Thus, it may be desirable to provide an alternative approach to detecting leaks in a purge valve which does not rely on pressure sensors in the fuel tank.

In one example approach to at least partially address these issues, a method for a vehicle with an engine comprises indicating a leak in response to a temperature change in a fuel vapor canister coupled to a fuel tank in an emission control system while the engine is in operation and a purge valve is closed. For example, a leak in the purge valve may be indicated in response to a temperature decrease in the fuel vapor canister while the engine is in operation and the purge valve is closed. In this way, the technical result of a leak in a canister purge valve being indicated even when a fault is present in a pressure sensor in the fuel tank can be obtained by using a temperature sensor, e.g., a thermocouple, in the canister to monitor temperature changes in the canister when the purge valve is closed.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
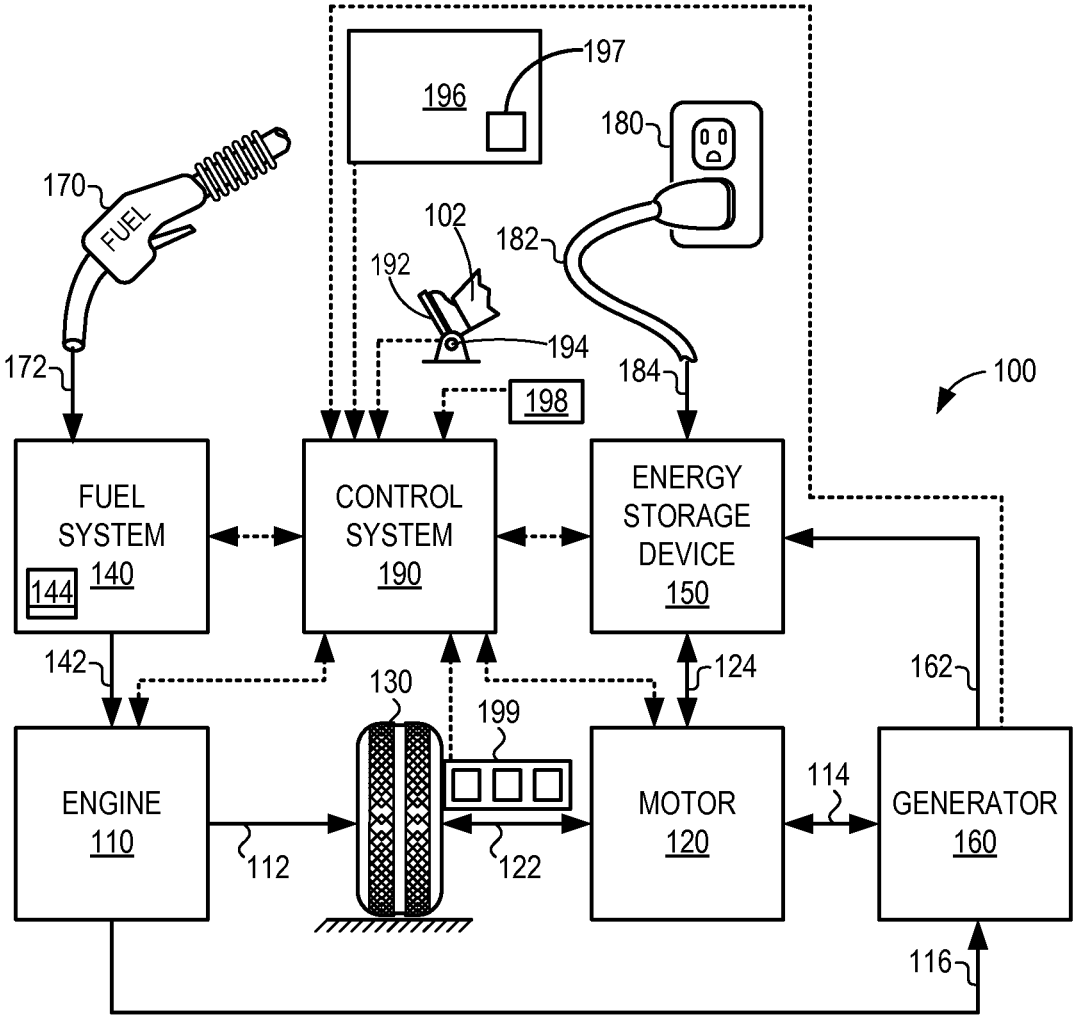
FIG. 1 shows an example vehicle propulsion system.
Figure 2:
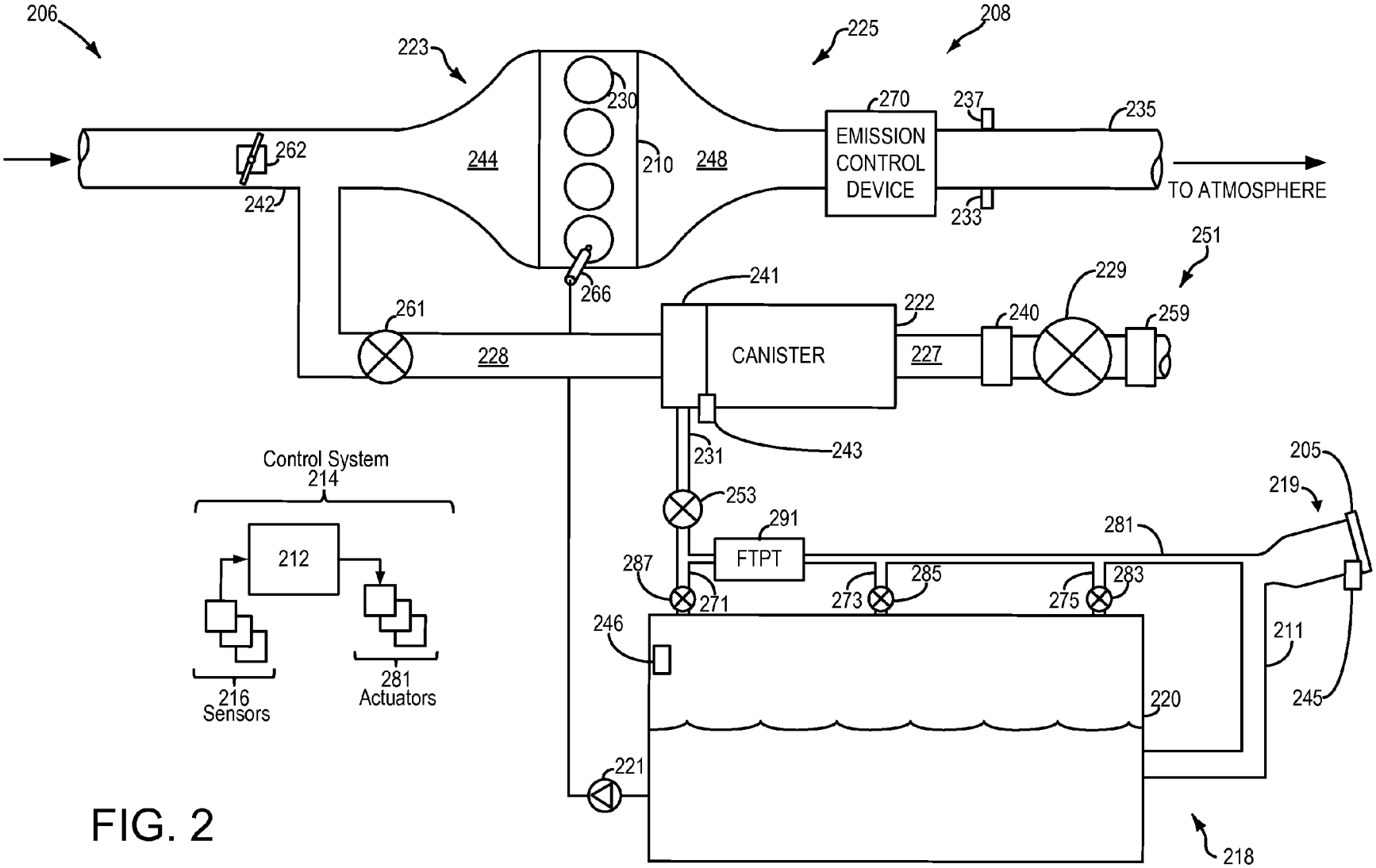
FIG. 2 shows an example vehicle system with a fuel system.

The following description relates to systems and methods for detecting a leak in an evaporative emissions control system in a vehicle system, e.g., the vehicle system shown in FIG. 1. The vehicle includes an engine system with a fuel system, as shown in FIG. 2, where the fuel system is coupled to an evaporative emission control system including a fuel vapor canister. As described below with reference to FIGS. 3 and 4, temperatures in the fuel vapor canister may be monitored during engine operation while a canister purge valve is closed to determine whether a leak is present in the evaporative emissions control system. For example, if a leak is present in a canister purge valve located in a conduit between the canister and the engine, then when the purge valve is closed and the fuel tank is sealed off from the atmosphere, vacuum in the fuel tank may increase causing fuel vapors stored in the canister to desorb from the adsorbent in the canister. The desorption of fuel vapor from the canister is an endothermic reaction thus leads to a decrease in temperature in the canister which may be used to indicate a leak.

Turning now to the figures, FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g. gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g. E10, E85, etc.) or a blend of gasoline and methanol (e.g. M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 3, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g. not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g. as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid vehicle system as described above with regard to FIG. 1. However, in other examples, vehicle system 206 may not be a hybrid vehicle system and may be propelled via the engine system 208 only.

The engine system 208 may include an engine 210 having a plurality of cylinders 230. The engine 210 includes an engine intake 223 and an engine exhaust 225. The engine intake 223 includes a throttle 262 fluidly coupled to the engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 218 may include a fuel tank 220 coupled to a fuel pump system 221. The fuel pump system 221 may include one or more pumps for pressurizing fuel delivered to the injectors of engine 210, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may include a temperature sensor 246 disposed therein.

Vapors generated in fuel system 218 may be routed to an evaporative emissions control system 251 which includes a fuel vapor canister 222 via vapor recovery line 231, before being purged to the engine intake 223. Fuel vapor canister 222 may include a buffer or load port 241 to which fuel vapor recovery line 231 is coupled. Further, a temperature sensor 243 may be included in fuel vapor canister 222 so that temperature changes in the fuel vapor canister may be monitored to assist in leak diagnostics as described below. The temperature sensor 243 may be located in load port 241 of fuel vapor canister 222 or in any other suitable location in canister 222. Fuel vapors undergo an endothermic reaction when fuel vapor is desorbed from the carbon in the canister, thus the temperature of the fuel vapor canister, e.g., as determined by temperature sensor 243, may decrease when during certain conditions when an amount of vacuum in the fuel tank increases pulling fuel vapor from the canister into the fuel tank. As described in more detail below, such temperature decreases in the fuel vapor canister may be used to assist in diagnostic routines, e.g., to determine if a leak is present in a canister purge valve or other components in the evaporative emission control system 251.

Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275. Further, in some examples, one or more fuel tank isolation valves may be included in recovery line 231 or in conduits 271, 273, or 275. Among other functions, fuel tank isolation valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283, and/or conduit 231 may include an isolation valve 253. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211. Further, a fuel cap locking mechanism 245 may be coupled to fuel cap 205. The fuel cap locking mechanism may be configured to automatically lock the fuel cap in a closed position so that the fuel cap cannot be opened. For example, the fuel cap 205 may remain locked via locking mechanism 245 while pressure or vacuum in the fuel tank is greater than a threshold. In response to an identification of a refueling event, the fuel tank may be depressurized and the fuel cap unlocked after the pressure or vacuum in the fuel tank falls below a threshold.

A fuel tank pressure transducer (FTPT) 291, or fuel tank pressure sensor, may be included between the fuel tank 220 and fuel vapor canister 222, to provide an estimate of a fuel tank pressure. As described below, in some examples, during engine-on conditions, sensor 291 may be used to monitor changes in pressure and/or vacuum in the fuel system to determine if a leak is present. The fuel tank pressure transducer may alternately be located in vapor recovery line 231, purge line 228, vent line 227, or other location within emission control system 251 without affecting its engine-off leak detection ability. As another example, one or more fuel tank pressure sensors may be located within fuel tank 220.

Emissions control system 251 may include one or more emissions control devices, such as one or more fuel vapor canisters, e.g., fuel vapor canister 222, filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 251 may further include a canister ventilation path or vent line 227 which may route gases out of the canister 222 to the atmosphere when storing, or trapping, fuel vapors from fuel system 218.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake 244 is provided to the fuel vapor canister for purging. In some examples, vent line 227 may include an air filter 259 disposed therein upstream of a canister 222.

Flow of air and vapors between canister 222 and the atmosphere may be regulated by a canister vent valve 229. Canister vent valve may be a normally open valve so that one or more fuel tank isolation valves, e.g., valves 87, 285, 283 or 253 may be used to control venting of fuel tank 220 with the atmosphere. For example, in hybrid vehicle applications, a fuel tank isolation valve may be a normally closed valve so that by opening the isolation valve, fuel tank 220 may be vented to the atmosphere and by closing the isolation valve, fuel tank 220 may be sealed from the atmosphere. In some examples, a fuel tank isolation valve may be actuated by a solenoid so that, in response to a current supplied to the solenoid, the valve will open. For example, in hybrid vehicle applications, the fuel tank 220 may be sealed off from the atmosphere in order to contain diurnal vapors inside the tank since the engine run time is not guaranteed. Thus, for example, a fuel tank isolation valve may be a normally closed valve which is opened in response to certain conditions. For example, a fuel tank isolation valve may be commanded open following a detection of a refueling event so that the fuel tank is depressurized for refueling.

Diagnostics may be performed on the evaporative emission control system 251 and/or fuel system 218, e.g., to detect leaks in the system. For example, diagnostics may be performed to test for leaks in the emission control system during engine off conditions, e.g., after a vehicle key off, to mitigate noise factors associated with vehicle dynamics such as road feedback, sharp-turn G forces, fuel sloshing, etc. During leak detection execution during engine-off conditions, a controller may operate in a low power mode with some sensors in the system depowered, e.g., a fuel level sensor may be turned off during leak detection. In some examples, engine off natural vacuum (EONV) may be used to provide vacuum for leak diagnostics. For example, vacuum increases in the fuel tank due to temperature changes may be monitored to determine if a leak is present in the fuel system. As another example, a pump 240 may be included in the emission control system to generate pressure or vacuum for leak diagnostics while the engine is not in operation. For example, pump 240 may be located in canister vent line 227 and may be actuated to generate an increased vacuum or pressure in the system. The pressure or vacuum changes in the system may be monitored for detecting leaks.

During some conditions, leak diagnostics may be performed during engine-on conditions when the engine is in operation. For example, as described below with regard to FIGS. 3 and 4, temperatures in the fuel vapor canister 222 may be monitored during engine-on conditions while the purge valve 261 is in a closed position and the fuel tank is sealed off from the atmosphere, e.g., via closing or maintaining vent valve 229 closed. An observed temperature decrease in the fuel vapor canister while the engine is in operation and the purge valve is closed may be indicative of a leak in the evaporative emission control system. For example, a temperature decrease occurring in the canister during these conditions may indicate that vacuum from the engine is being provided to the fuel tank via a leak in the canister purge valve to increase vacuum in the fuel tank so that fuel vapors are desorbed from the adsorbent in the canister. As such, a leak may be indicated in response to a temperature decrease in the canister during these conditions.

The vehicle system 206 may further include a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device, temperature sensor 233, pressure sensor 291, canister temperature sensor 243, and fuel tank temperature sensor 246. Other sensors such as pressure, temperature, air/fuel ratio, and composition sensors may be coupled to various locations in the vehicle system 206. As another example, the actuators may include fuel injector 266, throttle 262, valves 253, 287, 285, 283, and pump 240. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 3.

Figure 3:
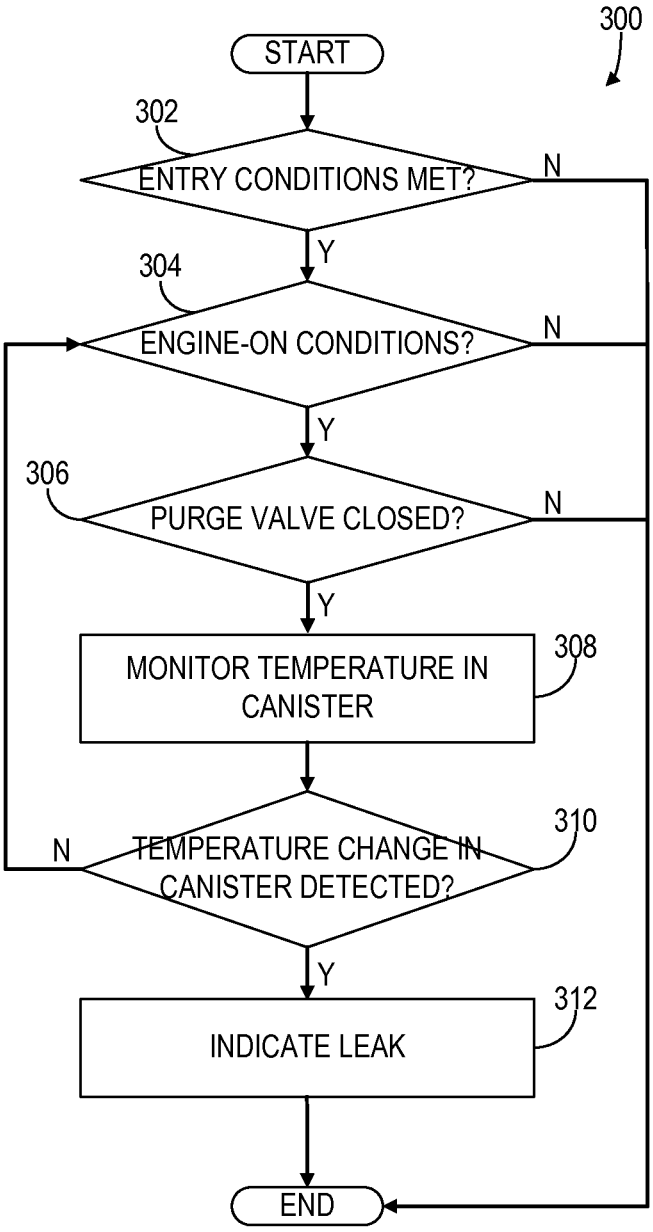
FIG. 3 shows an example method for detecting a leak in a canister purge valve in accordance with the disclosure.

FIG. 3 shows an example method 300 for performing leak diagnostics in an evaporative emission control system, e.g., system 251, during engine-on conditions. For example, method 300 may be used to determine if a leak is present in a canister purge valve, e.g., valve 261, disposed in a conduit, e.g., conduit 228, coupling the canister to an intake of the engine. In particular, if a leak is present in the purge valve while the engine is in operation and the fuel tank is sealed off from the atmosphere, then vacuum from an intake manifold of the engine may be provided to the fuel tank via the leak in the purge valve. The resulting vacuum increase in the fuel tank may draw fuel vapors from the fuel vapor canister into the fuel tank so that fuel vapors are desorbed from the adsorbent in the canister leading to a temperature decrease or cool down in the canister. This temperature decrease, e.g., as measured by temperature sensor 243 in the canister, may be used to determine the presence of a leak.

At 302, method 300 includes determining if entry conditions are met. Entry conditions may include any suitable entry conditions for performing leak diagnostics during engine-on conditions. Examples of diagnostic entry conditions include a temperature in the fuel system greater than a threshold and/or an amount of vacuum or pressure in the fuel system greater than a threshold. As another example, diagnostic entry conditions may be based on a diagnostic schedule. For example, if a threshold time duration has passed since a previous leak test then a leak test may be scheduled to perform at the next available opportunity, e.g., following a key-on event when the purge valve is closed, the fuel tank is sealed off from the atmosphere, and the engine is in operation.

In some examples, leak testing based on canister temperature changes while the engine is in operation may be performed instead of leak testing based on pressure sensor readings in the fuel tank, e.g., via pressure sensor 252. That is, indicating a leak in response to a temperature change in the fuel vapor canister may be performed in response to a fault in a pressure sensor coupled to the fuel tank. In this way, if a pressure sensor in the fuel tank becomes degraded, inoperable, or inaccurate, then leak testing based on temperatures in the canister may be performed to diagnose leaks. However, in some examples, leak testing based on canister temperature may be performed in addition to leak testing based on pressure readings from a pressure sensor in order to increase accuracy of the leak test and reduce false positive identifications of leaks.

Determining if entry conditions are met may also include determining if the fuel tank is sealed off from the atmosphere. e.g., by maintaining or closing vent valve 229. However, in certain applications, the fuel tank may remain sealed off from the atmosphere during engine operation by maintaining the vent valve 229 in a closed position. The vent valve 229 may be opened during engine-off conditions in response to an initiation of a refueling event.

If entry conditions are met at 302, method 300 proceeds to 304. At 304, method 300 includes determining if engine-on conditions are present. Engine-on conditions may include any vehicle condition where the engine is in operation. In hybrid vehicle applications, determining if engine-on conditions are present may include determining if the vehicle is operating in an engine-on mode. Engine-on conditions may follow a key-on event or other vehicle operator input which actuate engine operation. If engine-on conditions are present at 304, method 300 proceeds to 306.

At 306, method 300 includes determining if the purge valve is closed. For example, at 306, method 300 may include closing or maintaining a purge valve, e.g., valve 261 closed. For example, purge valve 261 may be normally closed but may be opened during certain conditions so that vacuum from engine intake 244 is provided to the fuel vapor canister for purging. During non-purging conditions the purge valve may be commanded to a closed position or may be maintained closed during engine operation. If the purge valve is closed at 306, method 300 proceeds to 308.

At 308, method 300 includes monitoring temperature in the fuel vapor canister. For example, temperature sensor 243 in canister 222 may be used to monitor temperature in the canister during the engine-on conditions when the purge valve is closed and the fuel tank is sealed off from the atmosphere. In some examples, monitoring temperature in the fuel vapor canister may further include compensating the measured temperatures in the fuel vapor canister for one or more of an ambient temperature, a fuel type, and an altitude. For example, temperature sensor 243 in fuel vapor canister 222 may be used to monitor temperatures in the fuel vapor canister while diagnostics are being performed to determine if leaks are present in the evaporative emission control system. As remarked above, temperature decreases in the canister during engine operation when the purge valve is closed and the fuel tank sealed off from the atmosphere may be used to detect leaks in the evaporative emission control system.

At 310, method 300 includes determining if a temperature change in the canister is detected while the temperature in the canister is monitored during engine-on conditions while the purge valve is closed and the fuel tank is sealed off from the atmosphere. For example, the temperature change in the canister may comprise any suitable temperature decrease, e.g., a temperature decrease below a predetermined temperature threshold. As another example, the temperature change may comprise a rate of temperature decrease in the canister greater than a threshold rate of temperature decrease.

If a temperature change in the canister is not detected at 310, then method 300 may proceed back to 304 and continue monitoring canister temperature while the engine is in operation and the purge valve is closed. During certain conditions, e.g., if a temperature change is not detected in the canister for predetermined time duration while the temperature in the canister is monitored during engine-on conditions while the purge valve is closed and the fuel tank sealed off from the atmosphere, then an indication of no leak may be performed.

However, if a temperature change in the canister is detected at 310, method 300 proceeds to 312. At 312, method 300 includes indicating a leak. For example, a leak may be indicated in response to the temperature change in the fuel vapor canister coupled to the fuel tank in the emission control system while the engine is in operation and a purge valve is closed. As remarked above, in some examples, indicating a leak may be further responsive to a pressure sensor coupled to the fuel tank. For example, indicating a leak may be further responsive to a pressure decrease in the fuel tank while the engine is in operation and the purge valve is closed. Further, indicating a leak in response to the temperature change in the fuel vapor canister may comprise indicating a leak in the purge valve. Indicating a leak may further include indicating a degradation of the fuel system so that mitigating actions may be performed. For example, a diagnostic code may be set in an onboard diagnostics system in the vehicle and/or a message may be sent to a message center in the vehicle to alert a vehicle operator of the degradation in the fuel system.

Figure 4:
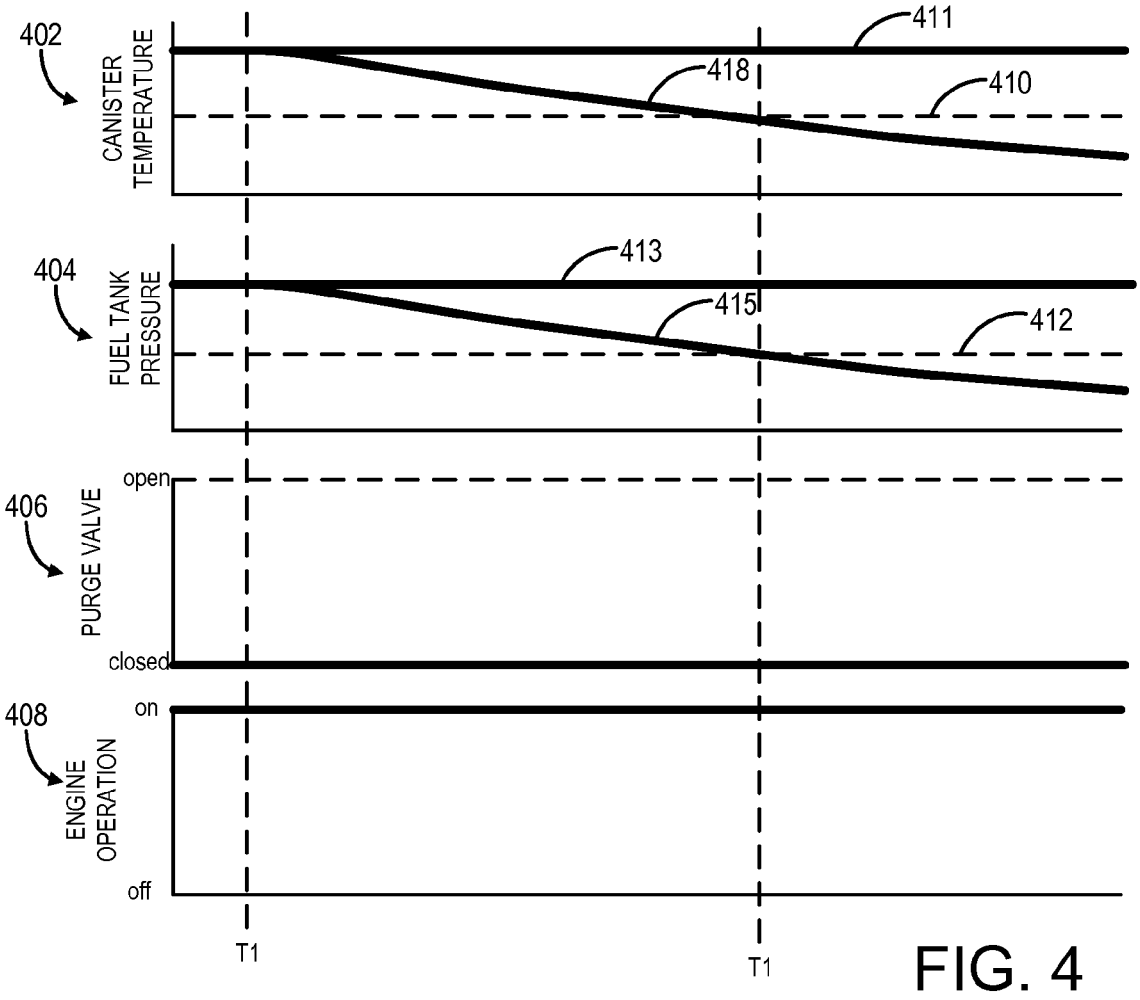
FIG. 4 illustrates an example method for detecting a leak in a canister purge valve in accordance with the disclosure.

FIG. 4 illustrates an example method, e.g., method 300 described above, for performing leak diagnostics in an evaporative emission control system during engine-on conditions based on temperature changes in a fuel vapor canister. The graph 402 in FIG. 4 shows canister temperature, e.g., as measured by temperature sensor 243, versus time. Graph 404 shows fuel tank pressure, e.g., as measure by pressure sensor 291, versus time. Graph 406 shows actuation of a canister purge valve, e.g., purge valve 261, versus time. Graph 408, shows engine operation versus time.

At time T1 in FIG. 4 an engine-on leak test is initiated while the engine is in operation, the purge valve is closed, and the fuel tank is sealed off from the atmosphere, e.g., by closing or maintaining a canister vent valve in a closed position. If substantially no leak is present in the evaporative emission control system, no significant temperature change may be measured or detected in the canister, as indicated by canister temperature 411, and no significant pressure change may be measured in the fuel tank, as indicated by pressure 413. However, if a leak is present, e.g., if there is a leak in the canister purge valve which is in the closed position, then a portion of engine vacuum may be communicated to the fuel tank so that pressure in the fuel tank decreases as indicated by pressure curve 415. In some examples, a leak may be indicated in response to this pressure decrease. For example, a leak may be indicated at time T2 when the pressure decreases below a threshold pressure 412. However, as remarked above, during some conditions, a pressure sensor may become degraded or it may be desirable to perform a leak test based on temperatures in the canister. As shown in curve 418, temperature in the canister may decrease in response to the decreasing pressure in the fuel tank due to the leak in the purge valve. Thus, a leak may be indicated in response to this temperature decrease. For example, a leak may be indicated at time T2 when the temperature in the canister decreases below a threshold temperature 410.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle with an engine comprising:

indicating a leak in response to a temperature change in a fuel vapor canister coupled to a fuel tank in an emission control system while the engine is in operation and a purge valve is closed;

wherein indicating the leak in response to the fuel vapor canister temperature change is performed in response to a fault in a pressure sensor coupled to the fuel tank.

2. The method of claim 1, wherein the temperature change comprises a temperature decrease in the canister.

3. The method of claim 1, wherein the temperature change comprises a temperature decreasing below a threshold temperature.

4. The method of claim 1, wherein the temperature change comprises a rate of temperature decrease in the canister greater than a threshold.

5. The method of claim 1, wherein indicating the leak is further responsive to a pressure sensor coupled to the fuel tank.

6. The method of claim 5, wherein indicating the leak responsive to the pressure sensor coupled to the fuel tank comprises indicating a leak in response to a pressure decrease in the fuel tank while the engine is in operation and a purge valve is closed.

7. The method of claim 1, wherein the purge valve is disposed in a conduit coupling the canister to an intake of the engine.

8. The method of claim 1, wherein the temperature change is compensated for one or more of an ambient temperature, a fuel type, and an altitude.

9. The method of claim 1, wherein the fuel vapor canister contains activated charcoal.

10. A method for a vehicle with an engine comprising:

during engine-on conditions:

closing or maintaining a purge valve closed; and indicating a leak in response to a temperature change in a fuel vapor canister coupled to a fuel tank in an emission control system;

wherein indicating the leak in response to the temperature change in the fuel vapor canister comprises indicating a leak in the purge valve.

11. The method of claim 10, wherein the temperature change comprises a temperature decreasing below a threshold temperature.

12. The method of claim 10, wherein the temperature change comprises a rate of temperature decrease in the canister greater than a threshold.

13. The method of claim 10, wherein indicating the leak in response to the temperature change in the fuel vapor canister is performed in response to a fault in a pressure sensor coupled to the fuel tank.

14. The method of claim 10, wherein indicating the leak is further responsive to a pressure decrease in the fuel tank while the engine is in operation and the purge valve is closed.

15. The method of claim 10, wherein during the engine-on conditions, the fuel tank is completely sealed off from atmosphere.

16. A method for a vehicle with an engine comprising:

indicating a leak in response to a temperature decrease in a fuel vapor canister coupled to a fuel tank in an emission control system while the engine is in operation and a purge valve is closed, where the purge valve is disposed in a conduit coupling the canister to an intake of the engine; and wherein indicating the leak in response to the temperature decrease in the fuel vapor canister is performed in response to a fault in a pressure sensor coupled to the fuel tank.

17. The method of claim 16, wherein the temperature decrease comprises a temperature decrease below a threshold temperature.

* * * * *